US011640864B2

(12) United States Patent
Schlais

(10) Patent No.: US 11,640,864 B2
(45) Date of Patent: May 2, 2023

(54) SYSTEM AND METHOD FOR DETECTING POSITION OF A SOLENOID PLUNGER

(71) Applicant: Deltrol Corp., Milwaukee, WI (US)

(72) Inventor: John Schlais, Franklin, WI (US)

(73) Assignee: Deltrol Corp., Milwaukee, WI (US)

( * ) Notice: Subject to any disclaimer, the term of this patent is extended or adjusted under 35 U.S.C. 154(b) by 608 days.

(21) Appl. No.: 16/704,649

(22) Filed: Dec. 5, 2019

(65) Prior Publication Data

US 2021/0174994 A1 Jun. 10, 2021

(51) Int. Cl.

| | |
|---|---|
| ***H01H 67/02*** | (2006.01) |
| ***H01F 7/06*** | (2006.01) |
| ***H01F 7/16*** | (2006.01) |
| ***H01F 7/126*** | (2006.01) |
| ***H01F 7/08*** | (2006.01) |

(52) U.S. Cl.

CPC ..... *H01F 7/064* (2013.01); *H01F 7/081* (2013.01); *H01F 7/126* (2013.01); *H01F 7/16* (2013.01); *H01F 2007/086* (2013.01)

(58) Field of Classification Search

CPC ..... H01F 7/064; H01F 7/081; H01F 7/126; H01F 7/16; H01F 2007/086; H01F 2007/185; H01F 7/1844; H01F 7/1607

USPC ..... 335/131; 361/170

See application file for complete search history.

(56) References Cited

U.S. PATENT DOCUMENTS 3,896,280 A 7/1975 Blake
4,494,098 A 1/1985 Haneda et al.
4,547,087 A 10/1985 Heider et al.
5,032,812 A * 7/1991 Banick ..... F16K 31/082 335/17
5,070,220 A * 12/1991 Glenn ..... F16L 55/10 200/82 E
5,420,385 A * 5/1995 Cooper ..... H01H 27/002 200/533
5,523,684 A * 6/1996 Zimmermann ..... H01F 7/1844 324/207.2
6,182,942 B1 * 2/2001 Kadlicko ..... F15B 21/087 251/129.1
6,265,956 B1 * 7/2001 Cascolan ..... H01F 7/1615 335/278
6,305,662 B1 * 10/2001 Parsons ..... F16K 31/0675 251/129.04

(Continued)

FOREIGN PATENT DOCUMENTS

JP S60-109679 6/1985
JP H08508233 A * 3/1996

*Primary Examiner* — Shawki S Ismail
*Assistant Examiner* — Lisa N Homza
(74) *Attorney, Agent, or Firm* — Andrus Intellectual Property Law, LLP

(57) ABSTRACT

A solenoid assembly includes a solenoid having a coil that defines a passageway and a plunger movable within the passageway from a retracted position to an extended position. The plunger extends along an axis between a first plunger end and an opposite second plunger end. A frame holds the solenoid and has a first opening through which the first plunger end extends when the plunger is in the retracted position and a second opening through second end of the plunger extends when the plunger is in the extended position. When the plunger is in the extended position the first plunger end retracts into the frame via the first opening.

8 Claims, 5 Drawing Sheets

(56) References Cited

U.S. PATENT DOCUMENTS 6,321,781 B1 * 11/2001 Kurth ..... F16K 37/0041 137/554
6,612,333 B2 * 9/2003 Miyazoe ..... F15B 13/0402 137/554
6,948,697 B2 * 9/2005 Herbert ..... F16K 37/00 251/129.17
7,864,008 B2 1/2011 Schilling
7,938,383 B2 5/2011 Zur et al.
8,228,149 B2 * 7/2012 Puth ..... H01F 7/1615 335/229
9,368,266 B2 * 6/2016 Mailer ..... H01F 7/1607
9,478,339 B2 * 10/2016 Gilmore ..... H01F 7/1615
9,953,786 B2 * 4/2018 Mecklenburg ..... H01H 50/22
9,982,797 B2 * 5/2018 Ye ..... H01F 7/127
10,365,124 B2 * 7/2019 Sugawara ..... H01F 7/1607
10,836,455 B2 * 11/2020 Valverde ..... B63B 13/00
10,876,663 B2 * 12/2020 Danielson ..... F16L 29/002
11,069,467 B2 * 7/2021 Kuramochi ..... H01F 7/16
2004/0201442 A1 * 10/2004 Herbert ..... E03D 1/36 335/220
2005/0099256 A1 * 5/2005 Subramanian ..... H01F 7/081 335/256
2006/0043683 A1 * 3/2006 Ocalan ..... E21B 43/1235 277/636
2006/0054851 A1 * 3/2006 Young ..... H01F 7/088 251/129.15
2008/0290974 A1 * 11/2008 Adams ..... F16K 37/0041 335/301
2010/0097165 A1 * 4/2010 Schilling ..... H01F 7/088 335/257
2011/0260085 A1 * 10/2011 van der Zee ..... F16K 37/0033 251/129.15
2013/0335177 A1 * 12/2013 Enomoto ..... H01H 1/20 335/185
2016/0020010 A1 * 1/2016 Maller ..... F02N 11/087 29/602.1
2019/0152565 A1 * 5/2019 Valverde ..... B63B 13/00
2020/0005979 A1 * 1/2020 Kuramochi ..... H01F 7/1607
2021/0174994 A1 * 6/2021 Schlais ..... H01F 7/1844

* cited by examiner

SYSTEM AND METHOD FOR DETECTING POSITION OF A SOLENOID PLUNGER

FIELD

The present disclosure relates to electromagnetic control devices, and specifically to solenoid assemblies and a system and method for determining and indicating plunger position.

BACKGROUND

Conventional solenoid assemblies include a coil or winding that defines a hollow passageway. A plunger positioned in the passageway moves between different positions as electrical power is applied to the coil. For instance, when electrical power is applied the coil, the plunger moves from a retracted position to an extended position. A return spring can be included in the solenoid assembly to move the plunger back to the retracted position when electrical power is no longer applied to the coil. An example of a conventional solenoid assembly is described in U.S. Pat. No. 7,864,008, which is incorporated herein by reference in entirety.

The plunger often has a plunger end that extends from a frame when the plunger is in the extended position, and the plunger end often performs some type of function or engages with an object. In one exemplary example, the plunger end extends from the solenoid frame and is received into a hole of an object to thereby lock movement of the object relative to the solenoid frame. In this example, the object cannot move relative to the frame until the plunger moves to the retracted position and the plunger end retracts into the frame. It can be appreciated that when the plunger end does not align with a locking recess of the object, the plunger end may contact the object such that the plunger does not fully move into extended position. In this blocked position, the plunger will not lock the object into the desired state. Thus, there is a need for a system and method for determining and indicating if the plunger actually moves into the fully extended position when the coil is energized.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a solenoid assembly includes a solenoid having a coil that defines a passageway and a plunger movable within the passageway from a retracted position to an extended position. In one embodiment, such movement occurs when the coil is energized. The plunger extends along an axis between a first plunger end and an opposite second plunger end. The second plunger end is designed to engage an object to carry out the designed functionality of the solenoid in a specific use application. A frame holds the solenoid and has a first opening through which the first plunger end extends when the plunger is in the retracted position and a second opening through second end of the plunger extends when the plunger is in the extended position. When the plunger is in the extended position the first plunger end retracts into the frame via the first opening.

In certain examples, a method for determining position of a plunger movable in a solenoid having a coil that defines a passageway includes the steps of positioning a plunger in the passageway such that the plunger moves in the passageway from a retracted position to an extended position. The plunger extends along an axis between a first plunger end and a second plunger end. The method further includes positioning the solenoid in a frame that has a first opening through which the first plunger end extends when the plunger is in the retracted position and a second opening through second plunger end extends when the plunger is in the extended position and sensing. A sensor is positioned on the solenoid frame to detect the state of the first plunger end. When the sensor detects the first plunger end extending through the first opening, the sensor generates a first electrical output. If the sensor does not detect the first plunger end, the sensor generates a second electrical output, where the first and second electrical outputs could be different electrical values or a simple on/off state. The method can further include determining with a control system position of plunger based on the electrical output generated by the sensor.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DISCLOSURE

Figure 1:
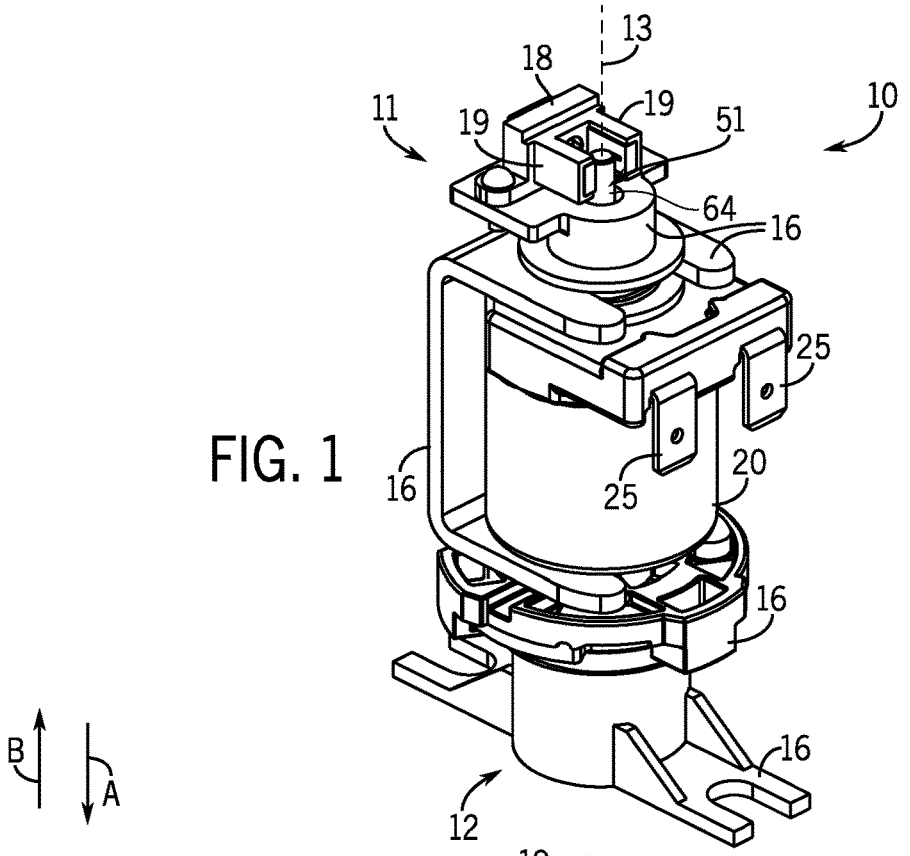
FIG. 1 is a perspective view of an example solenoid assembly of the present disclosure.
Figure 2:
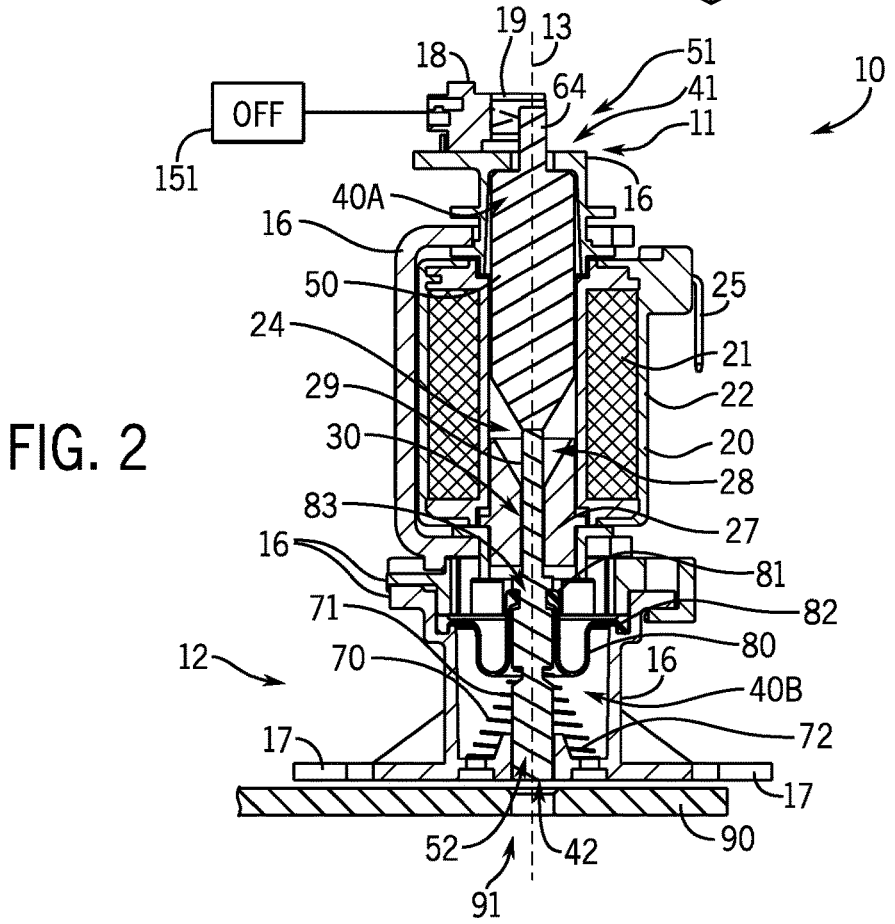
FIG. 2 is a cross-sectional view of the solenoid assembly of FIG. 1 with a plunger in a retracted position and a second plunger end aligned with a hole in an object.

FIGS. 1 and 2 illustrate a solenoid assembly 10 of the present disclosure. The assembly 10 generally extends along an axis 13 between a first end 11 and an opposite second end 12. The assembly 10 includes a solenoid 20 held in a frame 16 and a plunger 50 that moves relative to the frame 16 and the solenoid 20.

The solenoid 20 has an electromagnetic coil 21 that defines a cylindrical interior passageway 24 in which the plunger 50 moves. The coil 21 is surrounded by a protective housing 22, and electrical wires or contact arms 25 extend through the protective housing 22 to connect the coil 21 to an electrical power source (not shown). A plug 27 is received in the passageway 24, and the plug 27 extends out of the passageway 24 in a direction toward the second end 12 of the assembly 10. The plug 27 is generally cylindrical with a bore 30 extending there through. The plug 27 has a frustoconical cutout 28 and a funnel-shaped backstop surface 29 (described further herein). In certain examples, the plug 27 can be made from a magnetic steel component that completes a magnetic circuit when the gap between the plunger 50 and the plug 27 is closed upon energization of the coil 21.

As noted above, the solenoid 20 is held by the frame 16, and in the example depicted, the frame 16 includes multiple sections that are coupled together. The frame 16 includes mounting arms 17 positioned at the second end 12 of the assembly 10. The mounting arms 17 are for mounting the assembly 10 to another object. The frame 16 also includes a sensor mount 18 at the first end 11 of the assembly 10 to which a plunger sensor (described below) is coupled. The sensor mount 18 is generally "U"-shaped with two parallel arms 19.

The frame 16 defines a pair of cavities 40A, 40B that extends along the axis 13, and the cavities 40A, 40B align with the passageway 24. Specifically, a first cavity 40A extends along the axis 13 from the passageway 24 toward the first end 11 of the assembly 10 and a second cavity 40B extends along the axis 13 from passageway 24 toward the second end 12 of the assembly 10. The frame 16 also has a first opening 41 at the first end 11 of the assembly 10, and the first opening 41 is in communication with the first cavity 40A. A second opening 42 in the frame 16 is at the second end 12 of the assembly 10, and the second opening 42 is in communication with the second cavity 40B. The openings 41, 42 align with the axis 13.

The plunger 50 extends in the passageway 24 and the cavities 40A, 40B and moves axially as the solenoid 20 energizes and de-energizes as electrical power is applied or not applied, respectively, to the coil 21. The plunger 50 extends along the axis 13 and has a first plunger end 51 at the first end 11 of the assembly 10 and an opposite second plunger end 52 at the second end 12 of the assembly 10. Note that operation of the assembly 10 and movement of the plunger 50 is described herein below.

Figure 3:
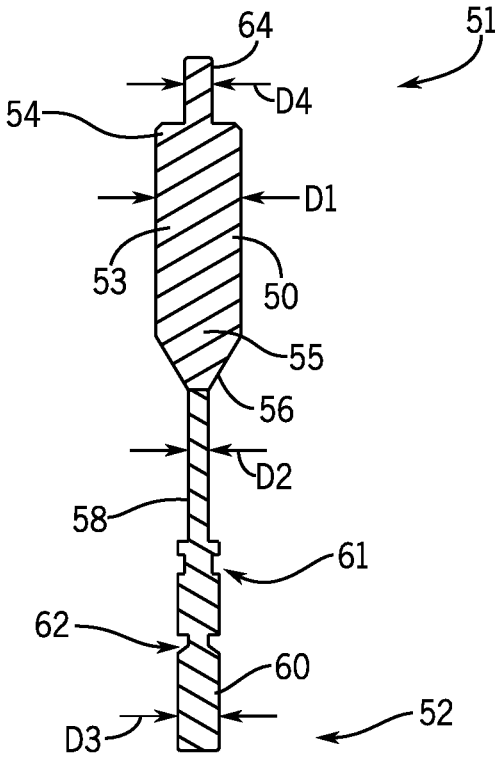
FIG. 3 is a cross-sectional view of the plunger.

Referring to FIG. 3, the plunger 50 is depicted in greater detail. The plunger 50 has an indicator tab 64 at the first plunger end 51, a locking pin 60 at the second plunger end 52, and a body 53 and a stem 58 that extend between the body 53 and the locking pin 60. The body 53 has a cylindrical first section 54 and a tapered furstro-conical second section 55. The first section of the body 53 has a first diameter D1 which corresponds to the diameter of the passageway 24 (FIG. 2). The second section 55 has an outer perimeter seating surface 56 that corresponds to the backstop surface 29. In the certain examples, the outer perimeter seating surface 56 is in the shape of a funnel. The stem 58 extends from the second section 55 of the body 53 and has a second diameter D2 which corresponds to the diameter of the bore 30 (FIG. 2) such that the stem 58 extends through the bore 30.

The indicator tab 64 is connected to the body 53, and the indicator tab 64 has a fourth diameter D4 that is less than the first diameter D1 of the body 53. The fourth diameter D4 can be equal to or less than the diameter of the first opening 41 (FIG. 2) such that the indicator tab 64 is movable through the first opening 41 (described further herein below). The locking pin 60 is connected to the stem 58 and has a first groove 61 and a second groove 62 that each encircle the stem 58. The locking pin 60 has a third diameter D3 that is greater than the second diameter D2 of the stem 58 and less than the first diameter D1 of the body 53. The third diameter D3 can be equal to or less than the diameter of the second opening 42 such that the locking pin 60 is movable through the second opening 42 (described further herein below). Note that the diameters D1, D2, D3, D4 of the different components of the plunger 50 can vary, and further, the diameters D1, D2, D3, D4 may vary relative to each other for the example plunger 50 depicted in FIG. 3. For instance, in one non-limiting example the second diameter D2 of the stem 58 equals the third diameter D3 of the locking pin 60.

Figure 4:
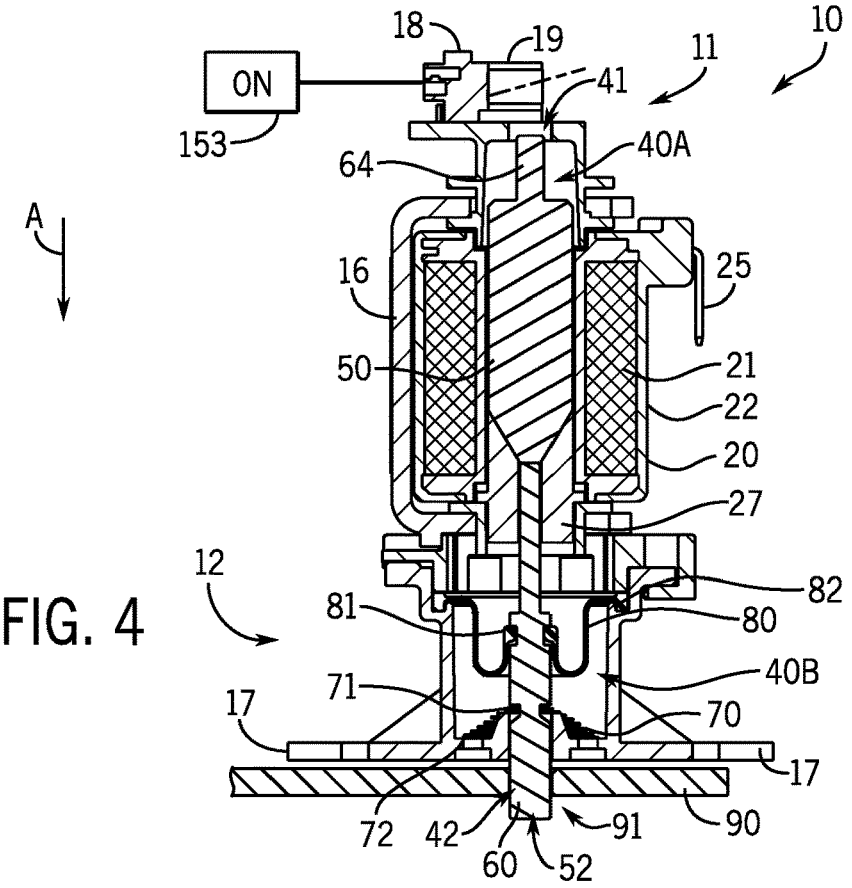
FIG. 4 is a cross-sectional view of the solenoid assembly of FIG. 1 with the plunger in an extended position and the second plunger end extending into the hole of the object.

Referring now to FIGS. 2 and 4, an example operational sequence of the assembly 10 is depicted. FIG. 2 depicts the coil 21 de-energized (electrical power is not flowing through the coil 21). Accordingly, the plunger 50 is in a retracted position in which the first plunger end 51 extends through the first opening 41 in the frame 16 and the second plunger end 52 is retracted into the frame 16. Specifically, the indicator tab 64 at the first plunger end 51 extends through the first opening 41 and into an area between the arms 19 of the sensor mount 18 as shown in FIG. 1. In this position, the indicator tab 64 is exposed and visible from outside the frame 16. At the same time, the second end 52 of the plunger 50 is retracted into the second cavity 40B via the second opening 42 in the frame 16. Specifically, the locking pin 60 at the second plunger end 52 is inside the second cavity 40B and does not extend from the frame 16.

In the embodiment shown, the plunger 50 is biased into the retracted position by a return spring 70 that has a first spring end 71 coupled to the plunger 50 and an opposite second end 72 coupled to the frame 16. The return spring 70 is positioned in the second cavity 40B, and the first spring end 71 is received in the second groove 62 of the plunger 50. The return spring 70 opposes movement of the plunger 50 in a first direction (see arrow A) toward the second end 12 of the assembly 10.

A diaphragm 80 is postioned between the plunger 50 and the frame 16. Specifically, the diaphragm 80 has an interior first perimeter edge 81 coupled to the plunger 50 and an opposite exterior perimeter edge 82 coupled to the frame 16. The diaphragm 80 is located in the second cavity 40B. The first perimeter edge 81 is received in the first groove 61 of the plunger 51 and the second perimeter edge 82 is clamped between two sections of the frame 16. The diaphragm 80 is positioned to prevent debris and/or moisture near the second end 12 of the assembly 10 from moving in a second direction (see arrow B) toward the first end 11 of the assembly 10. For instance, the diaphragm 80 prevents debris and/or moisture from moving from the second cavity 40B and into the passageway 24. The diaphragm 80 in this example is disc-shaped with a center aperture 83 defined by the first perimeter edge 81. Note that in other examples, the position, size, and/or shape of the diaphragm 80 can vary to any suitable position, size, and/or shape.

FIG. 4 depicts the coil 21 as energized (electrical power is flowing through the coil 21) with the plunger in an extended position. When the coil 21 is energized, the plunger 50 moves in the first direction (see arrow A) toward the second end 12 of the assembly 10 and into an extended position, as depicted in FIG. 4. In the extended position, the indicator tab 64 at the first plunger end 51 is retracted through the first opening 41 and thereby the indicator tab 64 is in the first cavity 40A and does not extend out of the frame 16 via the first opening 41. In addition, the second plunger end 52 extends through the second opening 42 and out of the frame 16. When the plunger is in the extended position, the locking pin 60 at the second plunger end 52 extends out from the second cavity 40B and the frame 16. Thus, the locking pin 60 can engage with another object, such as a plate 90. In this example, the locking pin 60 extends into a hole 91 defined in the plate 90 when the hole 91 is aligned with the second opening 42 in the frame 16.

As the plunger 50 moves from the retracted position (FIG. 2) into the extended position (FIG. 4), the plunger 50 compresses the return spring 70. In addition, the diaphragm 80 flexes downward and the first perimeter edge 81 moves with the plunger 50 such that the shape of the diaphragm 80 changes. However, the second perimeter edge 82 of the diaphragm 80 remains coupled to the frame 16 such that the diaphragm 80 does permit debris and/or moisture to move into the passageway 24, as noted above. Furthermore, the second section 55 of the body 53 moves into the cutout 28 of the plug 27 and the funnel surface 56 contacts the backstop surface 29. Thus, contact between the funnel surface 56 and the backstop surface 29 limits the movement of the plunger 50 toward the second end 12 of the assembly 10.

When electrical power no longer flows through the coil 21, the return spring 70 moves the plunger 50 back into the de-energized, retracted position (FIG. 2). Following this movement, the indicator tab 64 of the first plunger end 51 again extends through the first opening 41 in the frame 16 and the locking pin 60 at the second plunger end 52 is retracted into the frame 16, as described above. Furthermore, the diaphragm 80 also flexes and moves with the plunger 50.

Figure 5:
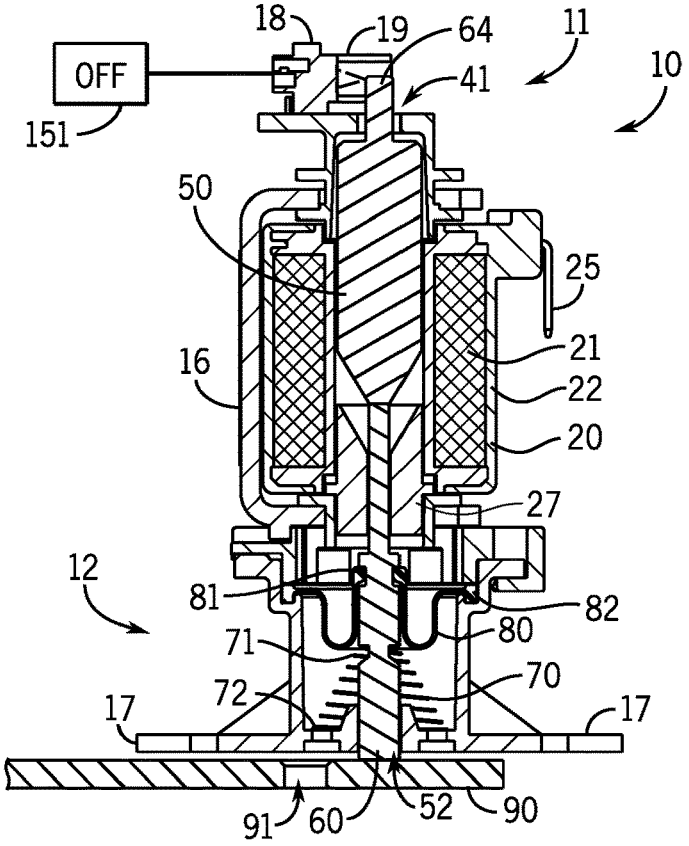
FIG. 5 is a cross-sectional view of the solenoid assembly of FIG. 1 with the plunger in an intermediate position and the second plunger end contacting the object.

FIG. 5 illustrates a condition in which the coil 20 is energized but the plate 90 is misaligned with the solenoid, which prevents the plunger 51 from moving into the extended position. In the misaligned position, the locking pin 60 on the second end 52 of the plunger cannot be received in the hole 91 in the plate 90. Thus the plunger 50 cannot completely move into the energized position (FIG. 4) because the locking pin 60 at the second plunger end 52 of the plunger 50 makes contact with the plate 90. Thus, the locking pin 60 is not received in the hole 91 in the plate 90 and the plunger 50 does not move into the energized position (FIG. 4). When the movement of the plunger 51 is blocked, the indicator tab 64 at the first plunger end 51 cannot fully retract into the first cavity 40A of the frame 16 via the first opening 41 and the indicator tab 64 remains exposed and extends into the area between the arms 19 of the sensor mounting 18. When these conditions occur, the solenoid assembly 10 is not properly operating or functioning and the exposed indicator tab 64 provides a visual indicator that the plunger 51 is not properly operating and not in the extended position. Thus, a technician can be alerted to the improper operation of the assembly 10 by visual inspection.

The assembly 10 includes a control system 100 that determines the position of the plunger 50 and the activation state of the solenoid and thereby determine if the solenoid assembly is operating properly. Generally, a control system 100 determines the position of the plunger 50 by monitoring the position of the indicator tab 64 and/or determines whether or not the solenoid assembly 10 is operating properly or improperly.

Note that certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

Figure 6:
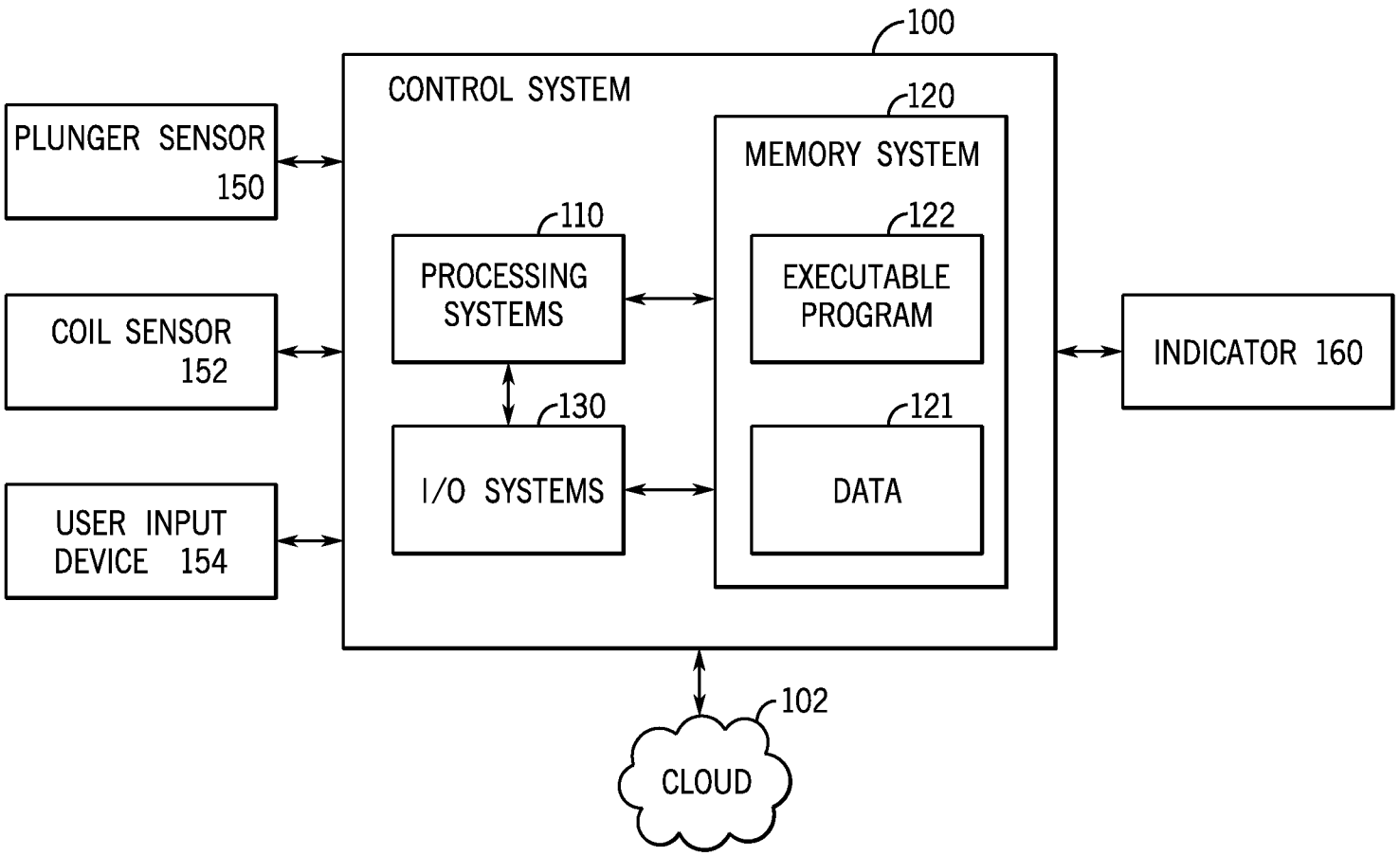
FIG. 6 is schematic diagram of an example control system of the present disclosure.

Referring to FIG. 6, the control system 100 may be a computing system that includes a processing system 110, memory system 120, and input/output (I/O) system 130 for communicating with other devices, such as input devices and output devices (described herein), either of which may also or alternatively be stored in a cloud 102. The processing system 110 loads and executes an executable program 122 from the memory system 120, accesses data 121 stored within the memory system 120, and directs the control system to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 121. The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

As noted above, the control system 100 communicates with and is operably connected to input devices and output devices. Example input devices include a plunger sensor 150, a coil activation sensor 152, and/or user input devices 154. The plunger sensor 150 is configured to sense the position of the plunger 50, such as by monitoring for the presence of the indicator tab 64. The plunger sensor 150 can be any suitable device such as a photoelectric sensor, a reflective-type photoelectric sensor, and the like. The coil sensor 152 is configured to sense if the coil 21 is energized or de-energized. In embodiments in which the processing system 110 controls the activation of the solenoid, the coil sensor 152 could be eliminated since processing system 110 would control the activation of the solenoid. The user input device 154 is configured to receives inputs, such as instructions, selections, and/or data from a user. The user input device 154 can be any suitable device such as a touch screen, a personal computer, personal cellular phones, and the like. Examples of output devices include indicators 160 such as audio devices (e.g., speakers), visual alarms (e.g., lights), and the like.

In one example, a plunger sensor 150 is a photoelectric sensor that detects the presence of the indicator tab 64 adjacent to the sensor and generates an electrical output based on the presence or lack of presence of the indicator tab 64. The electrical output could be an on/off state or varying voltage level depending upon whether the indicator tab 64 is detected.

In one example, the plunger sensor 150 is coupled to the sensor mount 18 at the first end 11 of the assembly 10 and oriented toward the indicator tab 64. When the plunger 50 is in the retracted position (FIG. 2), such that the indicator tab 64 at the first end 51 of the plunger 50 extends through first opening 41 in the frame 16, the plunger sensor 150 senses the indicator tab 64 and thereby generates a first electrical output 151, which is shown as the "off" state. When the plunger 50 is in the energized, extended position (FIG. 4), such that the indicator tab 64 is retracted into the frame 16, the plunger sensor 150 does not sense the tab 64 and a second electrical output 153 is generated, which is shown as the "on" state. In the state shown in FIG. 5 in which the solenoid coil is energized but the locking pin 60 is prevented from moving into the hole 91, the plunger sensor will generate the first electrical output 151, which indicates improper operation of the solenoid and the plunger. The first and second electrical outputs could be on or off as shown or could be different voltage or current levels.

Figure 7:
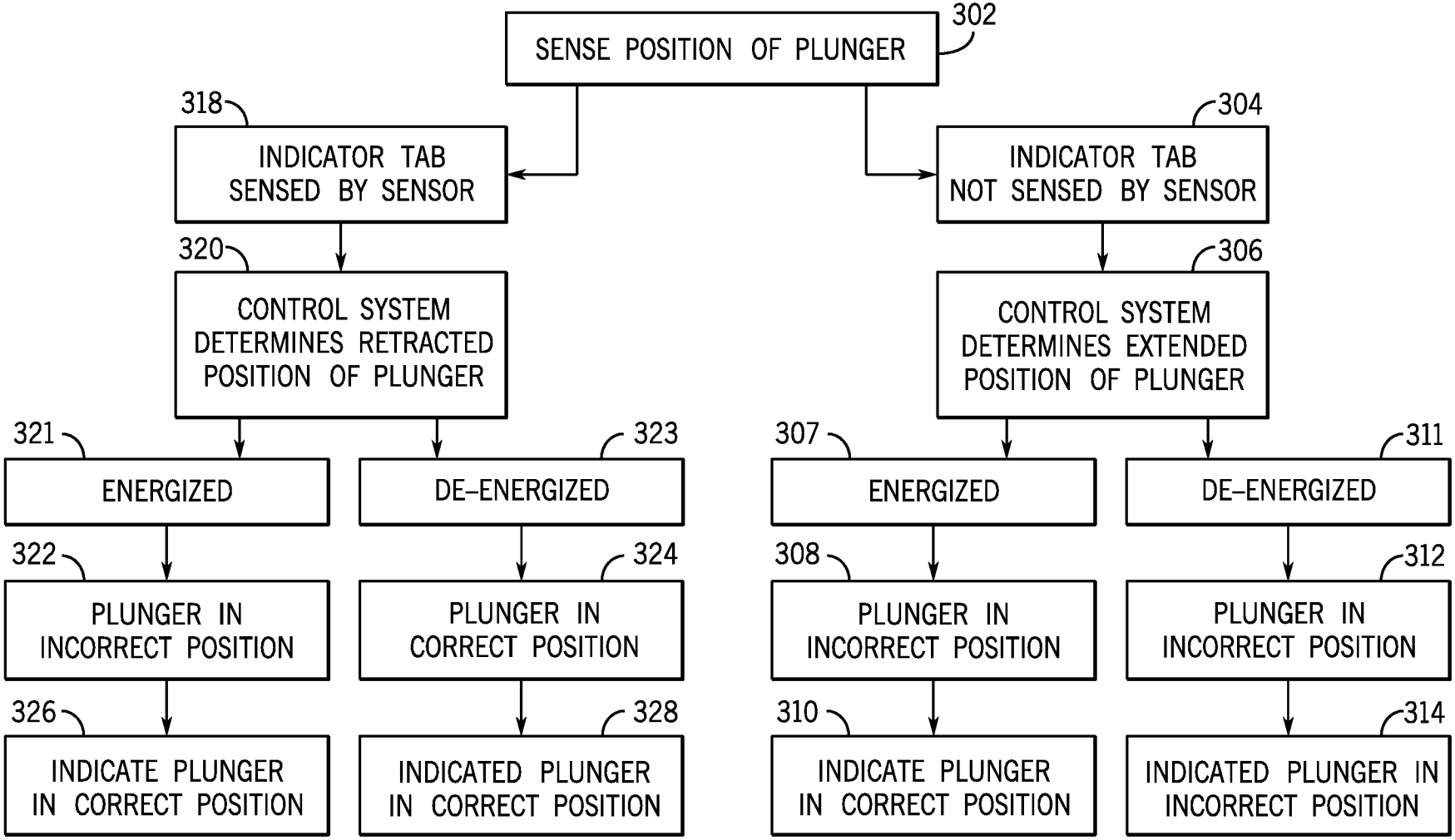
FIG. 7 is an example method for determining and indicating position of the plunger in the solenoid assembly of the present disclosure.

Referring to FIG. 7, an example method for determining and/or indicating operation of the solenoid assembly 10 is depicted. As shown at box 302, the method beings with sensing the presence of the indicator tab 64, with the plunger sensor 150. If the plunger sensor 150 does not sense the indicator tab 64 (at box 304), the plunger sensor 150 generates the second electrical output. At box 306, the control system 100 determines proper operation of the solenoid based on the position of the plunger 50 as indicated by the second electrical output from the plunger sensor 150 and the state (e.g., energized or de-energized) of the coil 21. If the coil 21 is energized (at box 307), the control system 100 determines that the plunger 50 is in the proper extended position (at box 308). The control system 100 then controls the indicator 160 to thereby indicate proper operation and that coil is energized and the plunger 50 is in the extended position (at box 310).

If the coil 21 is de-energized (box 311), the control system 100 determines that the plunger 50 is improperly in the extended position (at box 312) which may be caused by failure of the return spring 70. The control system 100 then controls the indicator 160 to thereby indicate that the plunger 50 is improperly in the extended position (at box 314).

The control system 100 could also be configured to permit additional functionality of a machine coupled to the control system 100 when the plunger 50 is properly in the extended position (FIG. 4) and the coil 21 is energized. For example, when the plunger 50 is in the extended position (FIG. 4), the second plunger end 52 engages a brew basket of a coffee machine thereby preventing the brew basket from being removed during operation. The control system 100 can be configured to permit the coffee machine to brew coffee via the brew basket when the plunger 50 is in the extended position (FIG. 4) thereby reducing the risk that the brew basket is not properly placed or to prevent the operator from removing the brew basket before completion of the brewing process thereby decreasing the risk that the hot water burns the operator.

Alternatively, if the plunger sensor 152 senses the indicator tab 64 (at box 318), the plunger is in the retracted position and the plunger sensor 152 generates the first electrical output which is received by the control system 100. At box 320, the control system 100 determines the plunger is retracted. The control system 100 next determines whether the retracted position of the plunger 50 is proper based on the state (e.g., energized or de-energized) of the coil 21. If the coil 21 is energized (box 321), the control system 100 determines (at box 322) that the plunger 50 is not in the proper extended position (FIG. 4) and that instead the plunger 50 is in the retracted position (FIG. 5). If the coil 21 is de-energized (box 323), the control system 100 determines that the plunger 50 is in the proper retracted position (FIG. 2). The control system 100 can control the indicator 160 to thereby indicate whether the plunger 50 is or is not in the desired retracted position (boxes 326, 328). When the control system 100 determines that the plunger 50 is not in the extended position (FIG. 4), the control system 100 could prevent functions or operations of the machine coupled to the control system 100. For example, the control system 100 may prevent the release of hot water when the plunger 50 is not in the extended position and the coil is energized to thereby prevent burning the operator.

In certain examples, the control system 100 can be configured to monitor electrical power to the coil 21 and/or determine whether or not electrical power is being applied to the coil 21. The coil sensor 152 may generate a defined electrical output when the coil 21 is energized, and the control system 100 receives the electrical output from the coil sensor 152 and determines that the coil 21 is energized.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A solenoid assembly comprising:

a solenoid having a coil that defines a passageway, wherein the coil is configured to energize when electrical power is applied to the coil;

a plunger movable within the passageway from a retracted position to an extended position, the plunger extending along an axis between a first plunger end and an opposite second plunger end, the first plunger end including an indicator tab;

a frame that holds the solenoid, the frame having a first opening through which the first plunger end extends when the plunger is in the retracted position and a second opening through which the second end of the plunger extends when the plunger is in the extended position;

a diaphragm that surrounds the plunger to prevent moisture from moving into the passageway, wherein the diaphragm has a first perimeter edge coupled to the plunger and an opposite second perimeter edge coupled to the frame, the first perimeter edge defines an aperture through which the plunger extends, wherein the inner first perimeter edge is coupled to the plunger between the first plunger end and the second plunger end; and a return spring that biases the plunger toward the retracted position, wherein when the coil is de-energized, the return spring moves the plunger toward the retracted position, wherein the return spring has a first spring end coupled to the plunger between the first perimeter edge and the second plunger end and an opposite second spring end coupled to the frame, wherein the plunger has a first groove in which the first perimeter edge of the diaphragm is received and a second groove in which the first spring end is received;

wherein when the plunger is in the extended position, the indicator tab on the first plunger end retracts into the frame via the first opening and when the plunger is in the retracted position, the indicator tab extend past the first opening; and a sensor mounted to the frame and operable to detect the indicator tab and generate an electrical output based on whether the indicator tab extends through the first opening.

2. The solenoid assembly according to claim 1, wherein when the plunger is in the retracted position, the second plunger end retracts into the frame via the second opening.

3. The solenoid assembly according to claim 1, further comprising:

a control system operably coupled to the sensor, wherein the control system determines the position of the plunger based on the electrical output generated by the sensor.

4. The solenoid assembly according to claim 3, wherein the sensor is a photoelectric sensor.

5. The solenoid assembly according to claim 3, further comprising an indicator operably coupled to the control system, and wherein the indicator indicates the position of the plunger.

6. The solenoid assembly according to claim 3, wherein the control system determines whether the plunger is in a proper position based on the electrical output from the sensor and the state of energization of the coil.

7. The solenoid assembly according to claim 6, further comprising an indicator operably coupled to the control system, and wherein when the control system determines that the plunger is not in the proper position, the indicator indicates that the plunger is not in the proper position.

8. The solenoid assembly according to claim 7, wherein when the control system determines that the plunger is not in the proper position, the control unit generates a control command.

* * * * *